US006793596B1

(12) United States Patent
Sullivan et al.

(10) Patent No.: US 6,793,596 B1
(45) Date of Patent: Sep. 21, 2004

(54) ARROWHEAD WITH PIVOTABLE BLADES

(76) Inventors: Kevin Michael Sullivan, 633 Ramey Rd., Lakemont, GA (US) 30552; Dennis Edward Sullivan, 1474 Camp Creek Rd., Lakemont, GA (US) 30552

( * ) Notice: Subject to any disclaimer, the term of this patent is extended or adjusted under 35 U.S.C. 154(b) by 0 days.

(21) Appl. No.: 10/744,234

(22) Filed: Dec. 22, 2003

(51) Int. Cl.[7] ..... F42B 6/08
(52) U.S. Cl. ..... 473/583
(58) Field of Search ..... 473/583, 584

(56) References Cited

U.S. PATENT DOCUMENTS

| | | | | |
|---|---|---|---|---|
| 4,901,467 | A | 2/1990 | Stolpe | |
| 5,564,713 | A | 10/1996 | Mizek et al. | |
| 5,820,498 | A | 10/1998 | Maleski | |
| 5,941,784 | A | 8/1999 | Mizek | |
| 6,165,086 | A | 12/2000 | Liechty, II | |
| 6,171,206 | B1 * | 1/2001 | Liechty, II | 473/583 |
| 6,174,252 | B1 | 1/2001 | Mizek | |
| 6,217,467 | B1 | 4/2001 | Maleski | |
| 6,270,435 | B1 * | 8/2001 | Sodaro | 473/583 |
| 6,287,223 | B1 | 9/2001 | Liechty, II | |
| 6,287,224 | B1 | 9/2001 | Liechty, II | |
| 6,398,676 | B1 | 6/2002 | Mizek | |
| 6,428,434 | B1 | 8/2002 | Liechty, II | |
| 6,554,727 | B1 * | 4/2003 | Armstrong et al. | 473/584 |

OTHER PUBLICATIONS

Grim Reaper™ Broadheads (Takin care of business at the front end of the arrow.™), "Are you going for Bambi? or Godzilla?," 1250 North 1750 West Provo, UT 84604–2955 (T—801.377.6199;F—877.694.5063; www.grimreaper-broadheads.com).

* cited by examiner

*Primary Examiner*—John A. Ricci
(74) *Attorney, Agent, or Firm*—Kilpatrick Stockton LLP

(57) ABSTRACT

An arrowhead with pivotal blades has a body with a mounting location adjacent a first end of the body. An elongated blade has a first end of the blade pivotably mounted to the mounting location of the body about an axis of rotation such that the blade is pivotably movable between first and second positions. The blade lies substantially parallel to the longitudinal axis of the body when in the first position with the second end of the blade adjacent the second end of the body, and the second end of the blade extends outward and closer to the first end of the body when the blade is in the second position. A bearing surface is formed at the second end of the blade so as to be contacted by a target surface to pivot the blade from the first position to the second position when the bearing surface strikes a target. The blade has a cam portion formed thereon adjacent the axis of rotation. A spring adjacent the axis of rotation of the blade is oriented to exert a force against the cam portion of the blade in the approximate direction of the axis of rotation. The cam portion of the blade is configured such that a biasing force tending to pivot the blade into the first position is exerted during a first minor portion of rotation of the blade between the first position and the second position.

22 Claims, 13 Drawing Sheets

ARROWHEAD WITH PIVOTABLE BLADES

TECHNICAL FIELD

The present invention relates generally to arrowheads, and relates more specifically to arrowheads with pivotably mounted blades which fold against the body for flight and deploy only after contact with the target.

BACKGROUND OF THE INVENTION

Arrowheads are known in which the blades are folded against the body while the arrow is in flight and then open on or after impact with the target. Having the blades folded against the body during flight increases the aerodynamic efficiency and accuracy of the arrowhead. Each blade is pivotably mounted to the arrowhead body at its rearward end. A beveled forward edge on each blade causes the blades to pivot rearward into an open position upon contact with the target, thereby extending the blades and increasing the cutting power of the arrowhead. The extent of the arc through which the blades travel determines the cut diameter of the arrowhead.

In a variation on this design, arrowheads suitable for bow fishing have their blades folded against the body during flight. These blades are pivotably mounted at their forward ends, however, and the blades remain folded against the body after contact with the target Once the arrow has penetrated through the body of the fish, if the struggling fish begins to work his way off the arrow, beveled surfaces at the rearward edges of the blades engage the fish and force the blades open, preventing the fish from sliding off the arrow.

SUMMARY OF THE INVENTION

Stated generally, the present invention comprises an arrowhead having a body with a mounting location adjacent a first end of the body. An elongated blade has a first end of the blade pivotably mounted to the mounting location of the body about an axis of rotation such that the blade is pivotably movable between first and second positions. The blade lies substantially parallel to the longitudinal axis of the body when in the first position with the second end of the blade adjacent the second end of the body, and the blade extending outward and toward or closer to the first end of the body when the blade is in the second position.

A bearing surface is formed at the second end of the blade so as to be contacted by a target surface to pivot the blade from the first position to the second position when the bearing surface strikes a target.

The blade has a cam portion formed thereon adjacent the axis of rotation. A spring adjacent the axis of rotation of the blade is oriented to exert a force against the cam portion of the blade in the approximate direction of the axis of rotation. The cam portion of the blade is configured such that a biasing force tending to pivot the blade into the first position is exerted only during a first minor portion of rotation of the blade between the first position and the second position.

In one preferred embodiment the mounting surface is adjacent the rearward end of the arrowhead body, and the bearing surfaces on the second ends of the blades face toward the forward end of the arrowhead body when the blades are in their first position. When the arrowhead strikes a target, the impact of the bearing surfaces with the target causes the blades to pivot and to deploy rearward.

In another preferred embodiment the mounting surface is adjacent the forward end of the arrowhead body, and the bearing surfaces on the second ends of the blades face rearward when the blades are in their first position. This arrowhead is suitable for bow fishing. When the arrow penetrates a fish, if the arrow tries to pull back through the fish, the blades will deploy substantially perpendicular to the longitudinal axis of the arrowhead body upon contact with the fish to prevent the arrowhead from passing back through the hole in the fish.

In one preferred embodiment, the axis of rotation is provided by an axle pin, and the spring adjacent the axis of rotation is provided by a spring pin substantially parallel to the axle pin. In still another preferred embodiment the axle pin and spring pin are joined at their upper ends to form a U-shaped unitary structure.

In another preferred embodiment the head of the blades is configured into a cam surface such that the spring pin bears against it only during predetermined portions of its rotation, thereby exerting a closing force during a first minor portion of rotation of the blades between their first and second positions.

Objects, features, and advantages of the present invention will become apparent upon reading the following specification, when taken in conjunction with the drawings and the appended claims.

DETAILED DESCRIPTION OF THE DISCLOSED EMBODIMENT

Figure 1:
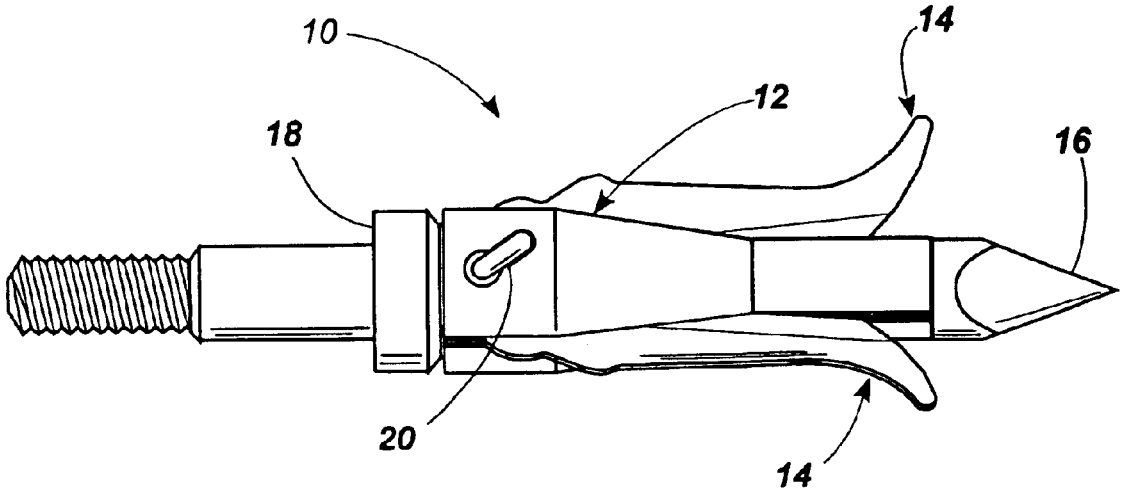
FIG. 1 is a side view of a first embodiment of an arrowhead according to the disclosed invention.
Figure 2:
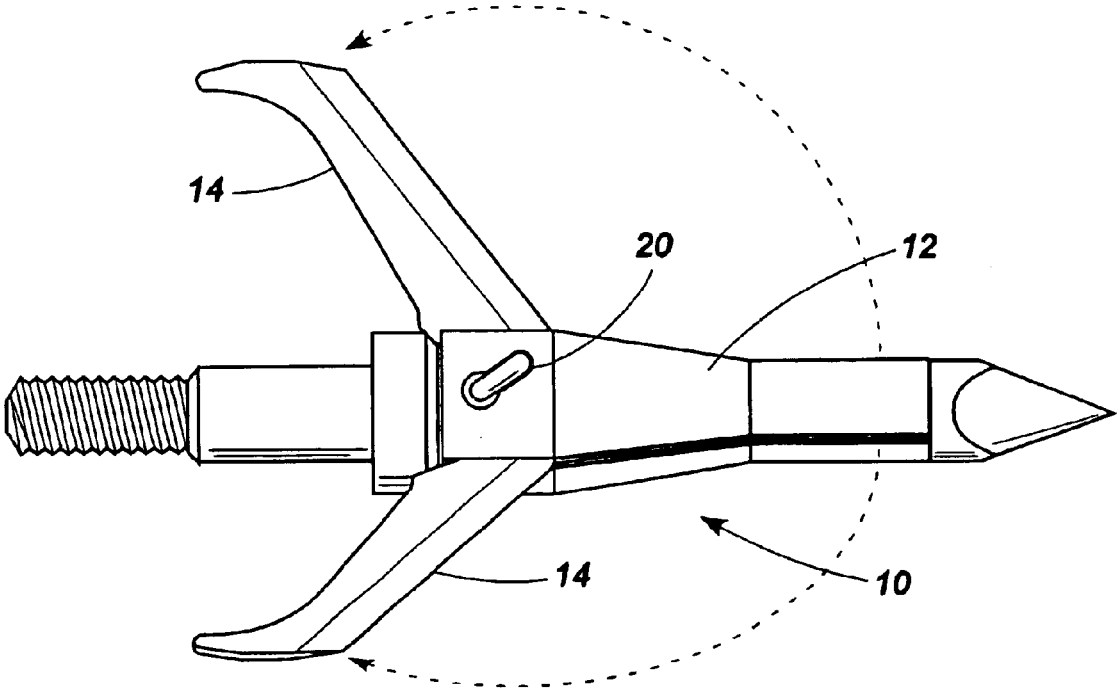
FIG. 2 is a side view of the arrowhead of FIG. 1 showing the blades extended in a deployed position.
Figure 3:
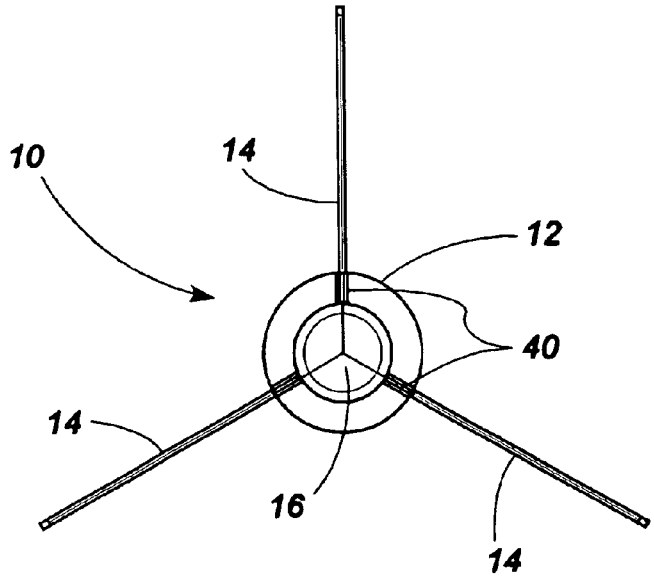
FIG. 3 is a front view of the arrowhead of FIG. 2.

Referring now to the drawings, in which identical numerals indicate identical elements throughout several figures, FIGS. 1–3 illustrate a first embodiment of an arrowhead 10 according to the present invention. The arrowhead 10 includes an arrowhead body 12, arrowhead blades 14 pivotably mounted to the arrowhead body 12, a tip 16, and a bearing ring 18. The arrowhead 10 also comprises an axle and spring assembly 20. Each of these components will be discussed in greater detail below.

As can be seen in FIG. 3, the arrowhead 10 comprises three blades 14 mounted at 120° intervals around the periphery of the arrowhead body 12. It will be understood, however, that a greater or lesser number of blades 14 can be employed without departing from the scope and spirit of the appended claims.

Figure 4:
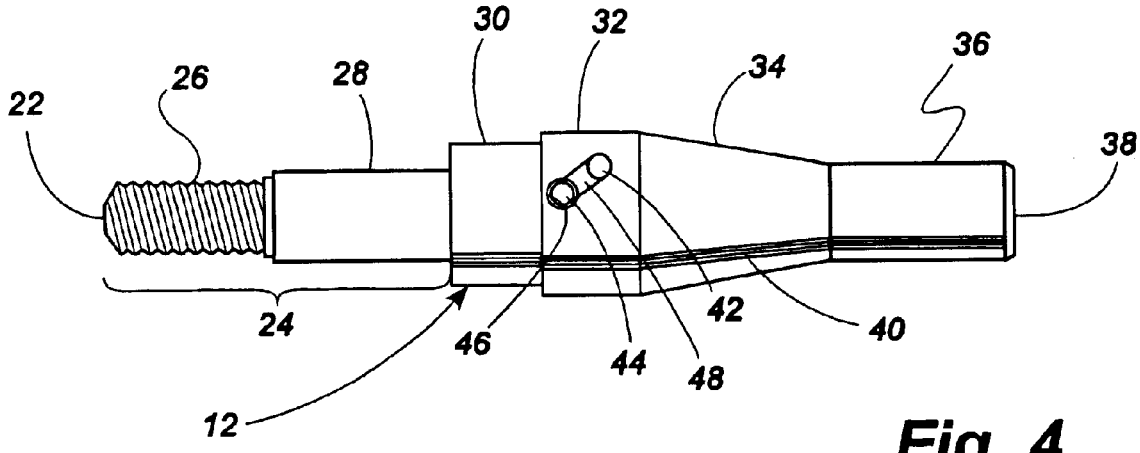
FIG. 4 is a side view of the arrowhead body of FIG. 1.

FIG. 4 shows the arrowhead body 12 in more detail. Starting at the rearward portion 22 of the arrowhead body 12, an integral mounting extension 24 consists of a threaded stud 26 and an alignment shoulder 28. The integral mounting extension 24 is joined to a bearing ring alignment surface 30. Just ahead of the bearing ring alignment surface 30 is the body major diameter 32. A transitional taper 34 narrows to the body tip diameter 36 at the forward end 38 of the arrowhead body 12.

Three longitudinal slots 40 (only one of which is visible in FIG. 4) are spaced equidistant around the periphery of the arrowhead body 12 and extend from the rearward edge of the bearing ring alignment surface 30 to a point just rearward of the forward end 38 of the arrowhead body. The slots 40 are of sufficient depth to receive a portion of the blades 14.

On the body major diameter 32, adjacent each of the slots 40 are a pair of axle and spring assembly mounting holes 42, 44 (only one pair of which can be seen in FIG. 4). The spring mounting hole 44 has a counterbore 46 to allow the spring room to move. A recess 48 is formed connecting the upper ends of the axle and spring assembly mounting holes 42, 44.

Figure 5:
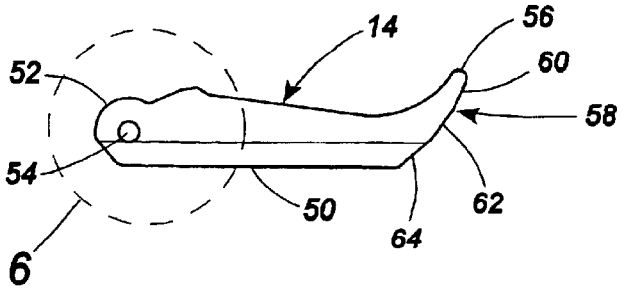
FIG. 5 is a side view of an arrowhead blade of the arrowhead of FIG. 1.
Figure 6:
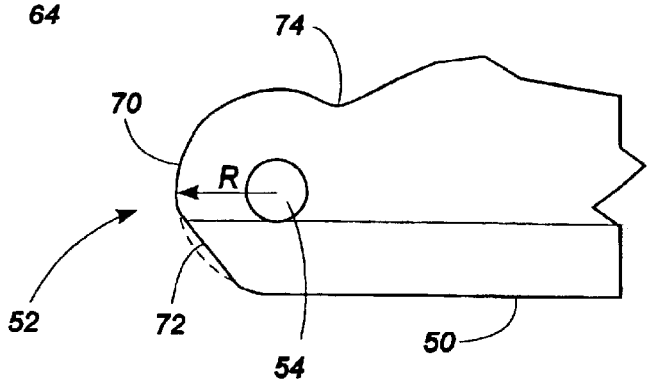
FIG. 6 is an enlarged view of the portion of the arrowhead indicated by the circle 6 in FIG. 5.

Referring now to FIGS. 5 and 6, each blade 14 comprises a sharp edge 50 and a head portion 52 through which a is cylindrical mounting hole 54 is formed. The periphery of the head 52 of the blade 14 is cam-shaped, for reasons of which will be explained below. The end 56 of the blade 14 opposite the head portion 52 comprises a slanted bearing portion 58 consisting of three straight facets 60, 62, 64.

Referring now to FIG. 6, the head portion 52 includes a first wall section 70 which is a distance R from the center of the mounting hole 54. The head 52 also includes a second section 72 adjoining the first section 70 and which is essentially straight. The second section 72 is spaced from the center of the mounting hole 52 by a distance less than R.

Figure 7:
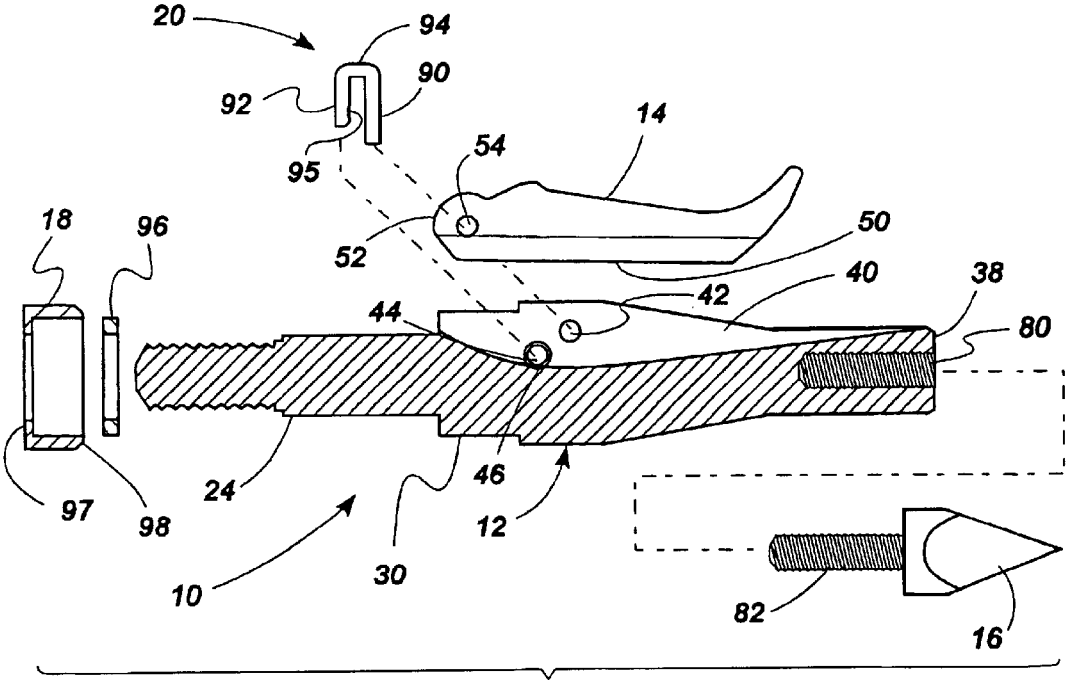
FIG. 7 is an exploded view of the arrowhead of FIG. 1.

FIG. 7 is an exploded view of the arrowhead 10 of FIGS. 1–3, showing only a single blade 14 for ease of illustration. The arrowhead body 12 has a threaded recess 80 in its forward end 38 for receiving a threaded shank 82 of the tip 16. In the alternative, the recess and shank can be smooth and configured for a press-fit. The slot 40 in the arrowhead body 12 receives the sharpened edge 50 of the blade 14 therewithin. As can be seen, a U-shaped axle and spring assembly 20 has an axle leg 90, a spring leg 92 extending substantially parallel to the axle leg 90, and a connector 94 connecting the upper ends of the axle leg 90 and spring leg 92. The spring leg 92 has a notch or recess 95 formed adjacent its lower end in the surface facing the axle leg 90. Notch 95 retains the relative relationship between the spring clip and the blade.

To assemble a blade 14 to the arrowhead body 12, the blade is first positioned within a slot 40. The sharpened edge 50 of the blade resides within the slot and the mounting hole 54 in the head 52 of the blade is aligned with the mounting hole 42 in the arrowhead body. The axle leg 90 and spring leg 92 fit through the holes 42 and 44 in the arrowhead body 12 (see, e.g., FIG. 4). The axle leg 90 then fits through the mounting hole 54 in the head 52 of the blade 14 and into the corresponding mounting hole 42 in other side of the slot the arrowhead body 12. The spring leg 92 of the axle and spring assembly 20 fits alongside the head 52 of the blade 14 and is received within the larger bore 46 in the arrowhead body 12.

The connector 94 is received within the recess 48 (FIG. 4) connecting the upper ends of the bores 42, 46. The recess 48 constrains the U-shaped axle and spring assembly 20 against rotation around the longitudinal axis of the axle leg 90. Since the spring leg 92 is not tightly received within its bore 46, there is room for lateral movement of the spring leg within its bore.

Also shown in FIG. 7 are a spacer washer 96 and the bearing ring 18 which fit over the integral mounting extension 24 of the arrowhead body 12 and engage the bearing ring alignment surface 30, as will be explained in more detail below. It will be noted that the spacer washer has a central opening which is dimensioned to receive the integral mounting extension 24 of the arrowhead body 12 therethrough but not the bearing ring alignment surface 30. Similarly, the bearing ring 18 has an inwardly extending annular flange 97 at its rearward end which is dimensioned to receive the integral mounting extension 24 of the arrowhead body 12 therethrough but not the bearing ring alignment surface 30. Conversely, the opening at the forward end 98 of the bearing ring 18 will receive the bearing ring alignment surface 30 therethrough.

Figure 8:
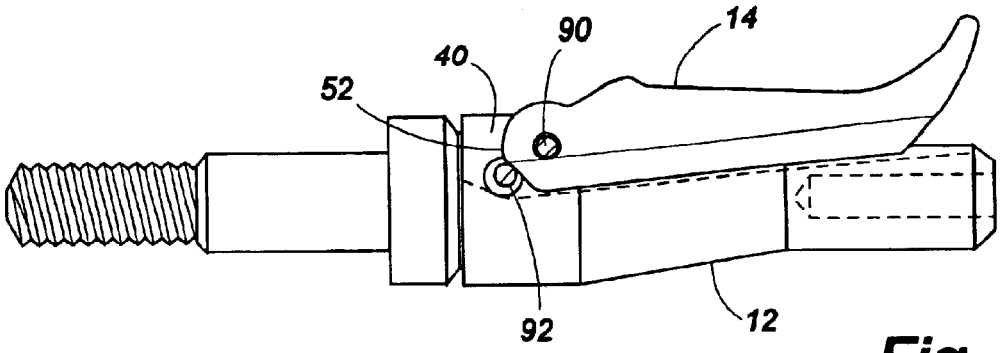
FIG. 8 is a side view of the arrowhead of FIG. 1 partially cut away to reveal interior detail.
Figure 9:
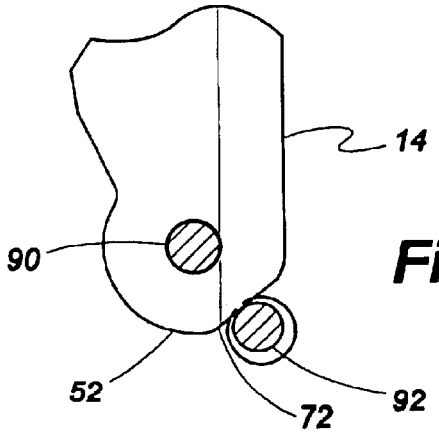
FIG. 9 is an enlarged view of the blade head and spring assembly of the arrowhead of FIG. 8.

Reference is now made to FIGS. 8–15, as the operation of the spring leg 92 to bias the blade 14 toward a closed position is explained. Referring first to FIGS. 8 and 9, with the blade 14 completely closed and the blade lying against the arrowhead body 12 and partially within the slots 40, the spring leg 92 resides against the flattened second portion 72 of the head 52 of the blade, which is separated from the axle by a distance of less than R. At this point the spring leg 92 is under minimal tension, as the distance between the center of the axle pin 90 and the closest surface of the spring leg 92 is also less than R.

Figure 10:
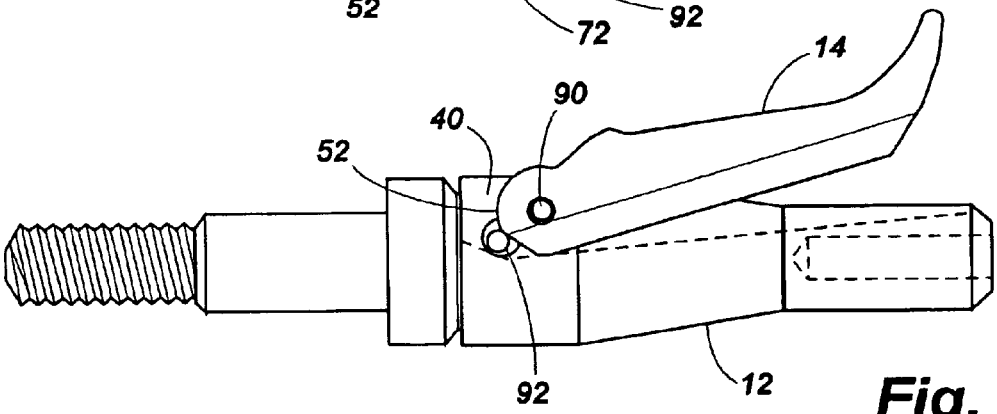
FIG. 10 is a view of the arrowhead of FIG. 1 with the blade partially extended and with the body partially cut away to reveal interior detail.
Figure 11:
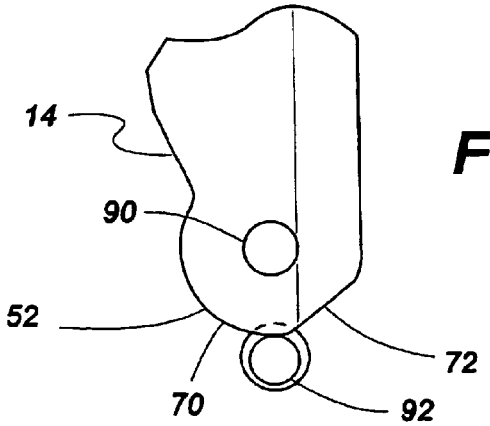
FIG. 11 is an enlarged view of the head portion of the blade and spring assembly of FIG. 10.

Referring now to FIGS. 10 and 11, the blade 14 has been rotated outwardly by about 10 degrees. In order to rotate the blade 14, the force of the spring leg 92 has had to be overcome, as the spring leg has now reached a position on the periphery of the head 52 of the blade 14 which is spaced farther from the axle pin 90 than the position shown in FIG. 9. If the blade 14 were released at any point between the position shown in FIG. 8 and the position shown in FIG. 10, the inward action of the spring leg 92 would tend to rotate the blade back to the position shown in FIG. 8. Thus, for a first minor portion of the blade's rotation, the force of the spring leg 92 tends to return the blade 14 to its closed position.

Figure 12:
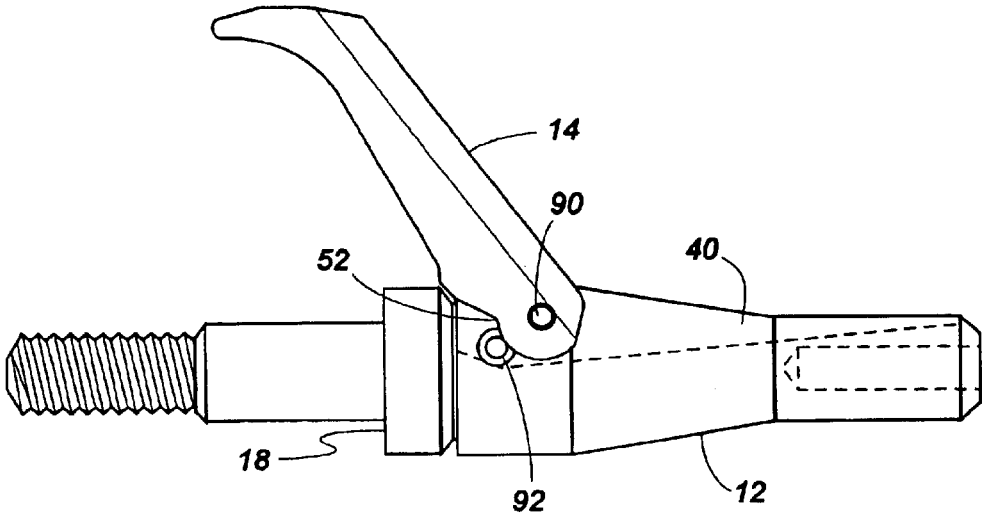
FIG. 12 is a side view of the arrowhead of FIG. 1 with the blade fully deployed and with the body partially cut away to reveal interior detail. A bearing ring is used without any spacer is washers to provide a blade engaging surface as far forward as possible.
Figure 13:
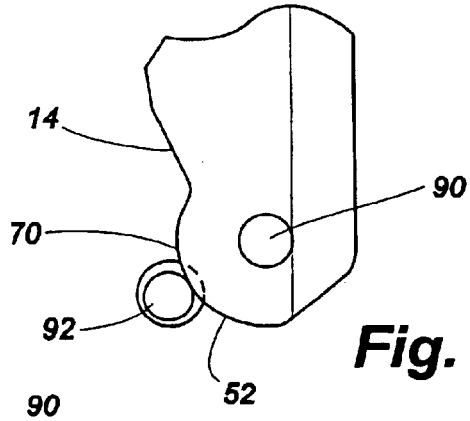
FIG. 13 is an enlarged view of the blade head and spring assembly of the arrowhead of FIG. 12.

Referring now to FIGS. 12 and 13, as the blade 14 continues to open, the spring leg 92 rides along the portion 70 of the blade head 52 which has a constant radius. Thus the force exerted by the spring is radially inward, directly toward the axle 90, and there is no component of the force exerted by the spring leg 92 which tends to either open or close the blade 14. Depending upon the position of the bearing ring 18, as will be explained below, the position of the blade in FIG. 12 may be as far as the blade opens.

Figure 14:
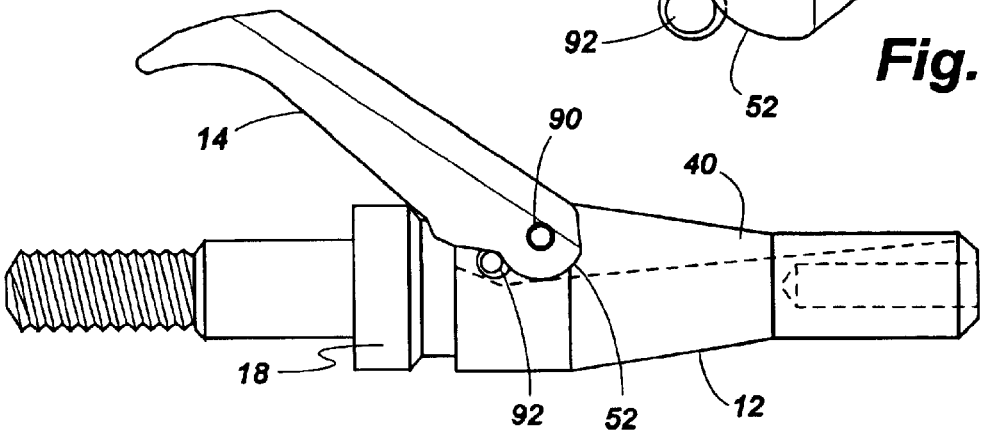
FIG. 14 is a side view of the arrowhead of FIG. 1 with the blade fully deployed. The arrowhead of FIG. 14 employs the bearing ring with at least one spacer washer to displace the blade contact point rearward. The body of the arrowhead is partially cut away to reveal the interior detail.
Figure 15:
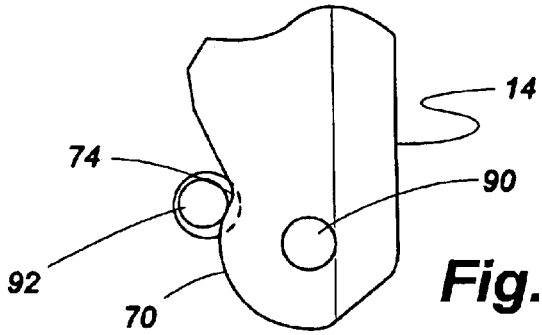
FIG. 15 is an enlarged view of the blade head and spring assembly of the arrowhead of FIG. 14.
Figure 16:
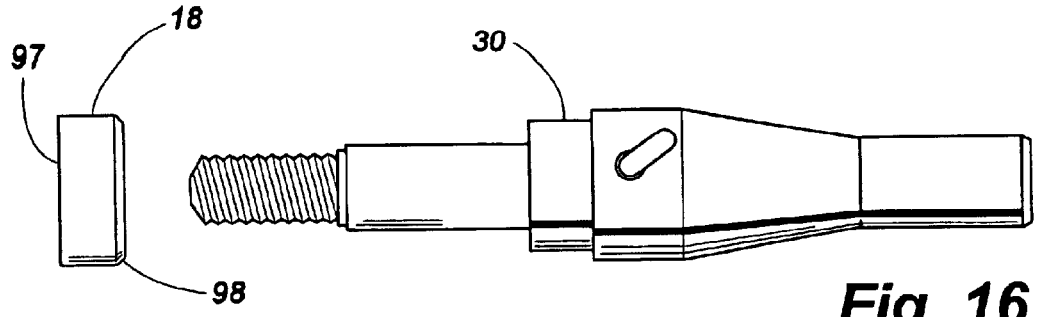
FIG. 16. is a side view of the arrowhead body of FIG. 4 showing the bearing ring exploded off of it.

Referring now to FIGS. 14 and 15, if the bearing ring is positioned as shown in FIG. 14, the blade will open further, to the position shown in FIG. 14. This represents the maximum distance by which the blade 14 can open.

Figure 17:
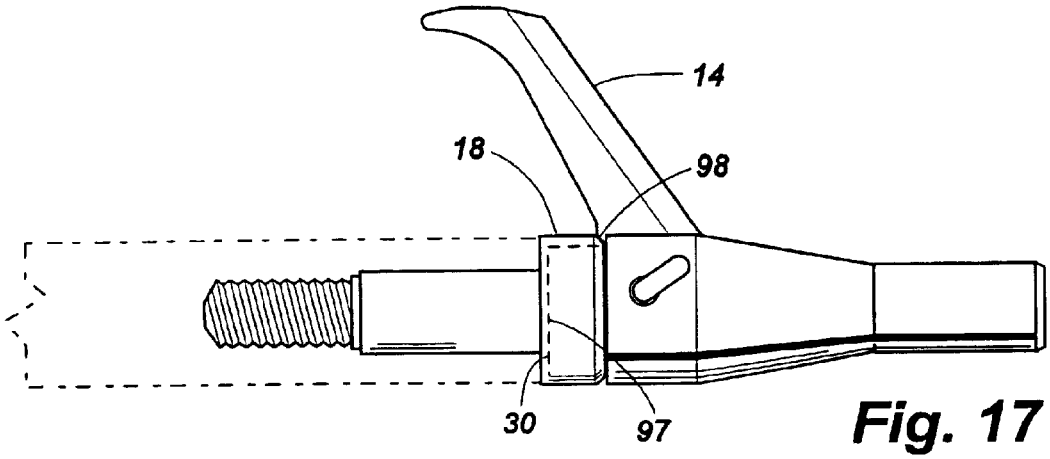
FIG. 17 is a side view of the arrowhead body of FIG. 16 showing the bearing ring installed on the arrowhead body and showing an arrowhead shaft in phantom lines.

Reference is now made to FIGS. 16–19, where the function and operation of the bearing ring 18 will be explained. The bearing ring 18 has a central opening which is dimensioned to receive the bearing ring alignment surface 30 of the blade body 12 therewithin. However, the radially inwardly extending flange 97 of the bearing ring 18 will abut the rearward face of the bearing ring alignment surface and prevent any further advancement of the bearing ring. As shown in FIG. 17, the ring has been advanced to its maximum forward position. The tapered forward edge 98 of the bearing ring 18 thus serves as a stop surface to prevent the blade 14 from rotating any further rearward and thus serves as a maximum limit on the extent of rotation of the blades.

Figure 18:
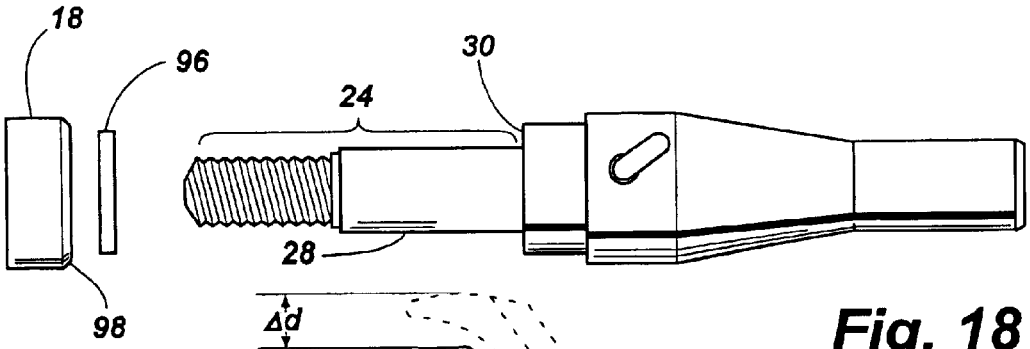
FIG. 18 is side view of the arrowhead body of FIG. 4 showing a bearing ring and a spacer washer exploded off the end of the arrowhead body.
Figure 19:
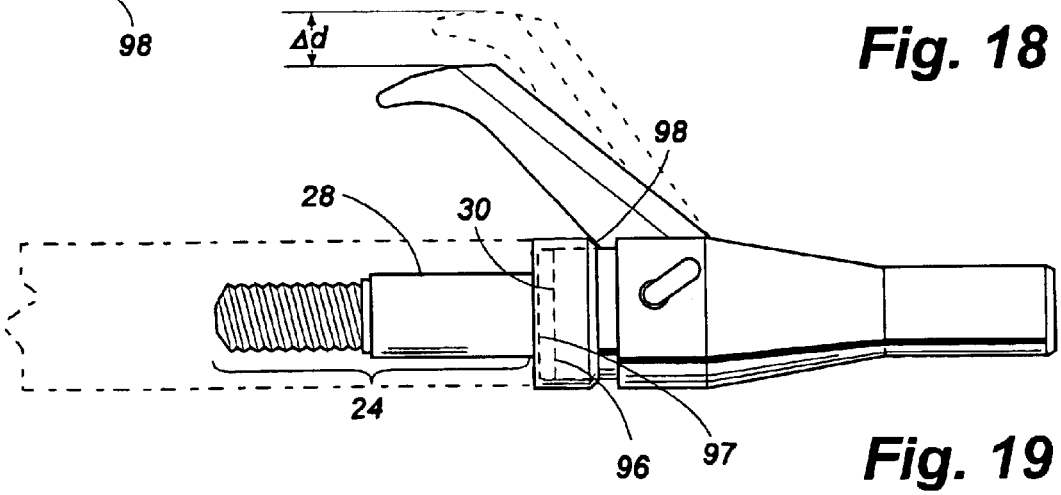
FIG. 19 shows the spacer washer and bearing ring installed in the arrowhead body with an arrowhead shaft shown in phantom lines.

Looking at FIGS. 18 and 19, a spacer washer 96 has a central opening dimensioned to be received over the alignment shoulder 28 of the integral mounting extension 24 but will abut the rearward face of the bearing ring alignment surface 30. When the spacer washer 96 is put on ahead of the bearing ring 18, the annular flange 97 at the rearward edge of the bearing ring 18 will confront the spacer washer 96 before confronting the rearward face of the bearing ring alignment surface 30. Thus the bearing ring 18 is unable to advance as far forward as in FIG. 17. Consequently, as shown in FIG. 18, the blade 14 is able to rotate further rearward before confronting the beveled forward edge 98 of the bearing ring 18. By controlling the width and number of spacer washers 96 and the configuration of the bearing ring 18, various combinations of blade positions can be attained, all with the same arrowhead body 12 and blades 14.

Figure 20:
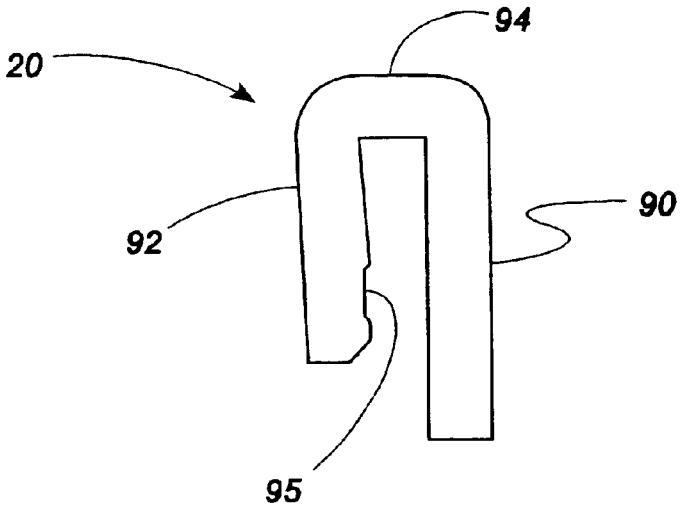
FIG. 20 is a side view of a U-shaped axle and spring assembly of the arrowhead of FIG. 1.
Figure 21:
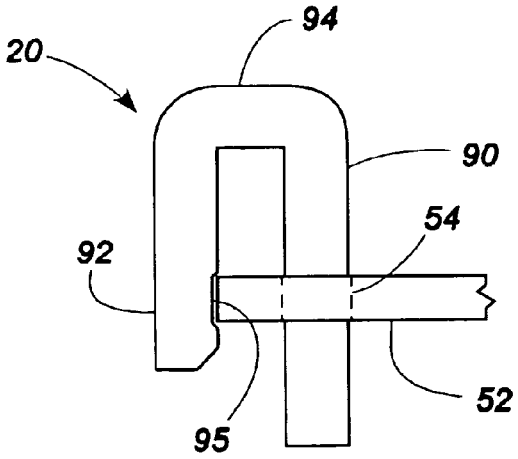
FIG. 21 is a side view of the U-shaped axle and spring assembly of FIG. 20 showing a blade mounting on the axle pin, with the spring pin exerting minimal force on the blade.
Figure 22:
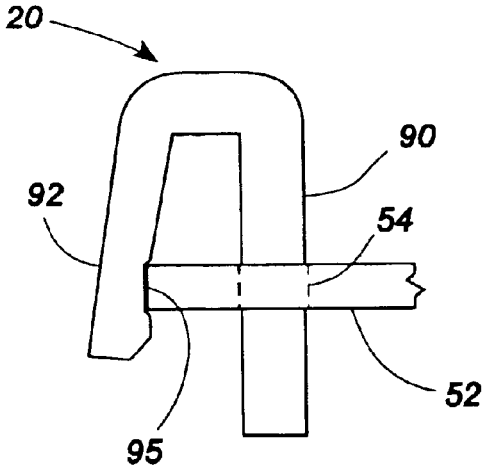
FIG. 22 shows a side view of the axle and spring assembly with a blade installed on the axle pin and with the spring pin exerting a radially inward force on the periphery of the blade head.

Referring now to FIGS. 20–22, operation of the U-shaped axle and spring assembly 20 will be explained. Referring first to FIG. 20, the assembly comprises the axle leg 90, a shorter spring leg 92, and a bridging member 94 connecting the upper end of the axle leg in the upper end of the spring leg to form an inverted U-shaped member. The spring leg has a notch 95 formed adjacent its lower end and facing the axle leg 90.

In FIG. 21, the head 52 of the blade 14 is shown mounted on the axle leg 90 at the position shown in FIG. 9, where the spring leg 92 is applying minimal pressure to the periphery of the blade head 52.

In FIG. 22, the blade head 52 has rotated to the position shown in FIG. 11, for example. The spring leg 92 has been biased away from its normal position, and the resiliency of the spring leg 92 is applying a radially inward force against the peripheral surface of the blade head 52. If the blade head 52 is positioned between those positions depicted in FIGS. 9 and 11, the spring leg 92 will tend to rotate the blade 14 back to its closed position. Once the blade 14 passes the position shown in FIG. 11, the force exerted by the spring leg 92 will be neutral as far as opening or closing the blade.

Figure 23:
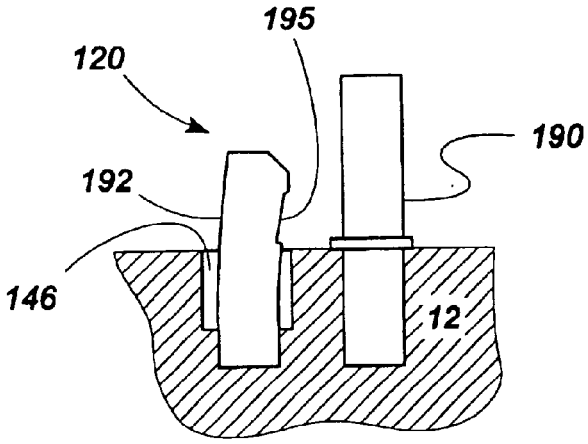
FIG. 23 illustrates an alternate embodiment in which the axle pin and the spring pin are independent elements.
Figure 24:
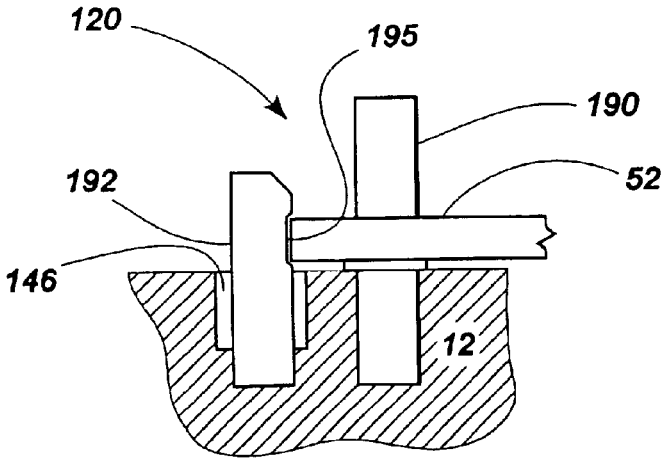
FIG. 24 illustrates the axle pin and spring pin of FIG. 23 with a blade installed on the axle and the spring pin exerting minimal force on the periphery of the blade head.
Figure 25:
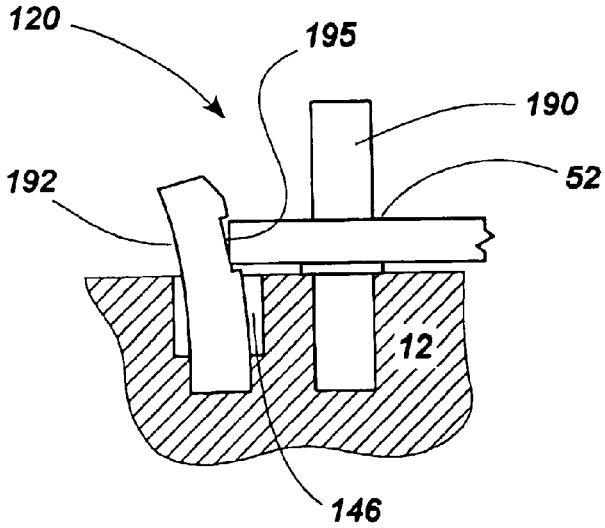
FIG. 25 shows the separate axle and spring assembly of FIG. 23 with a blade mounted on the axle pin and the spring pin exerting a radially inward force on the head of the blade.

FIGS. 23–25 illustrate an alternate embodiment of an axle leg and spring leg assembly 120 in which the axle leg 190 and spring leg 192 are independent elements. As shown in FIG. 23, the axle leg 190 is mounted in the arrowhead body 12, and the spring leg 192 similarly has its lower end mounted in the arrowhead body in spaced-apart relation to the axle leg. Unlike the axle leg 190, however, the spring leg 192 has a counter bore 146 which provides room for the spring leg to bend toward and away from the axle leg. Thus when a blade 14 is mounted on the axle leg 190, as shown in FIGS. 24 and 25, and the blade head 52 rotates, the spring leg 192 can be displaced so as to exert a force on the periphery of the blade head.

Figure 26:
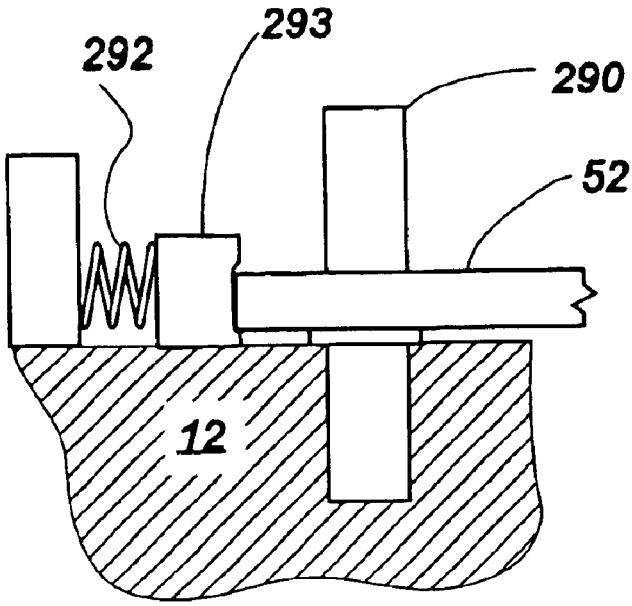
FIG. 26 illustrates still another embodiment of an axle pin and a spring wherein the spring this time is a coil spring.
Figure 27:
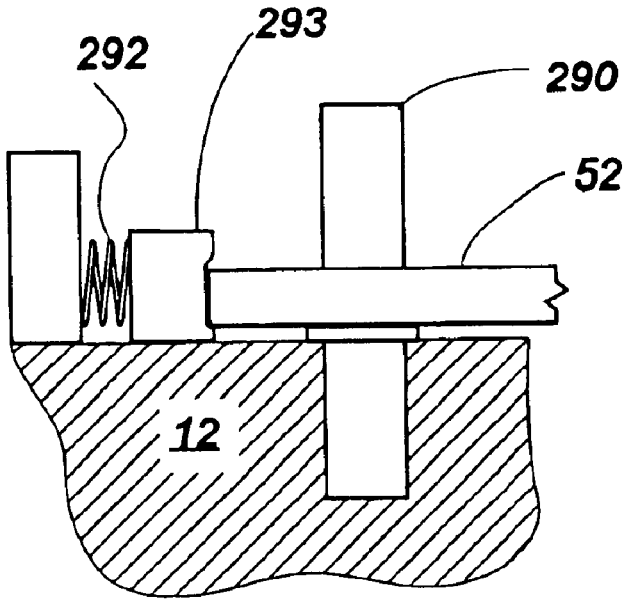
FIG. 27 illustrates the coil spring of FIG. 26 exerting a radially inward force on the periphery of the head of the blade.

FIGS. 26 and 27 illustrate yet another embodiment of an axle leg and a spring biasing a blade 14 back to its closed position during a first minor portion of its rotation. In this embodiment, however, rather than using a leaf-type spring, a coil spring 292 is used. The coil spring 292 biases a bearing element 293 directly against the periphery of the head 52 of the blade 14 which tends to bias the blade back to its closed position during the first minor portion of rotation of the blade.

FIGS. 28–36 illustrate another embodiment 310 of an arrowhead according to the present invention. The arrowhead 310 comprises an arrowhead body 312, blades 314, and a tip 316. An axle and spring assembly 320 pivotally mounts the forward end of the blades 314 to the arrowhead body 312 in the same manner as explained above with respect to the arrowhead 310.

The arrowhead 310 is especially adapted for bow fishing. The blades 314 are maintained close to the body 312 while the arrow is in flight, and the blades do not even deploy when the arrowhead strikes a target. Rather, the blades 314 remain in their retracted position as the arrowhead penetrates a fish. Then, once the arrowhead 310 has exited the other side of the fish, if the struggling fish tries to work its way off the arrow, the blades 314 will deploy to prevent the arrowhead 310 from pulling back through the fish.

Figure 28:
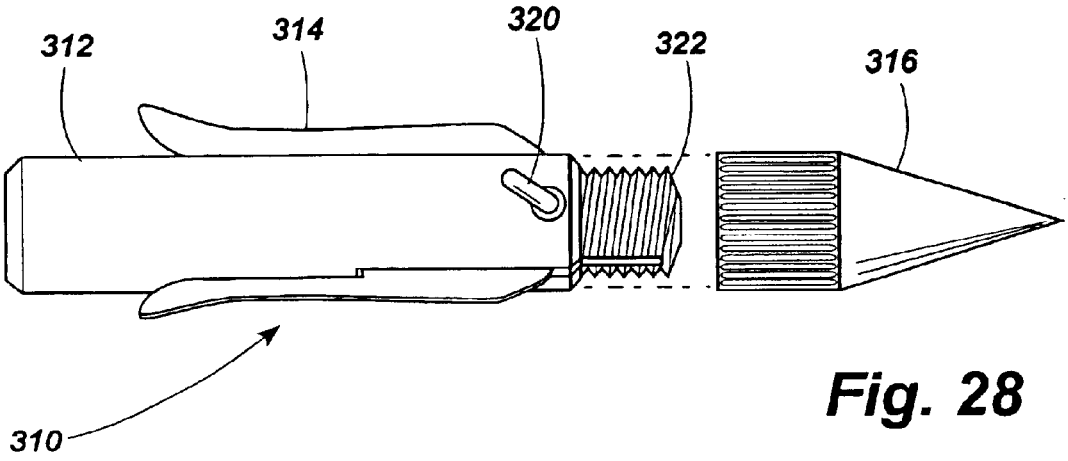
FIG. 28 illustrates an alternate embodiment of an arrowhead with the blades pivotable at their forward ends, such as would be desirable in the case of a bow fishing arrowhead.
Figure 29:
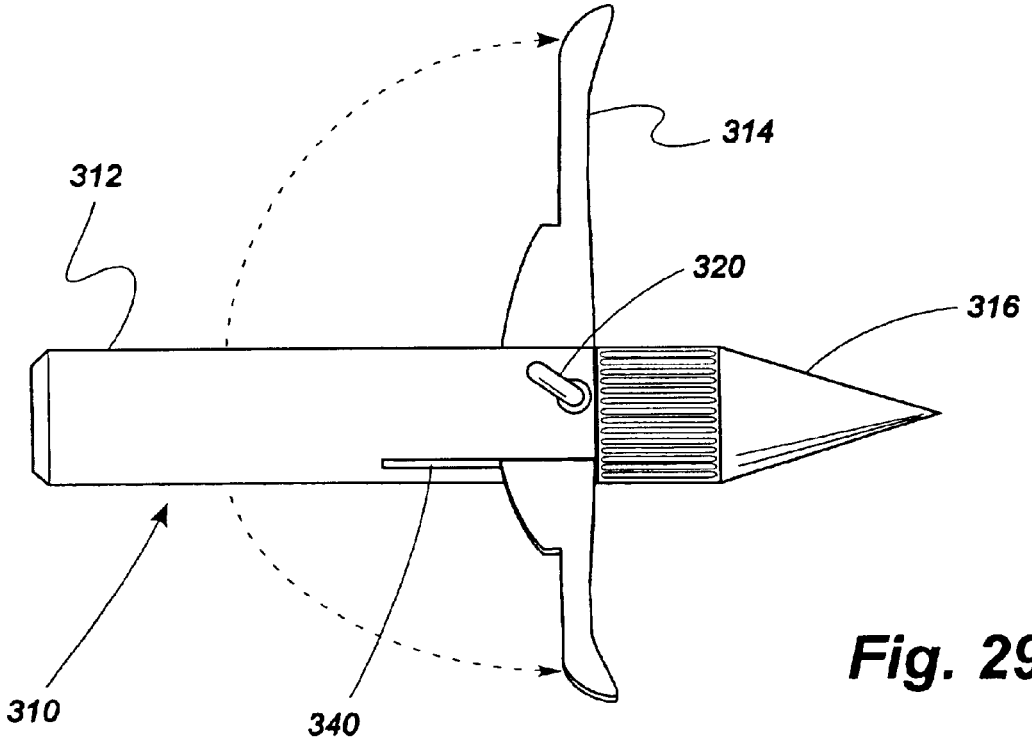
FIG. 29 is a side view of the arrowhead of FIG. 28 showing the blades in their extended or deployed position.
Figure 30:
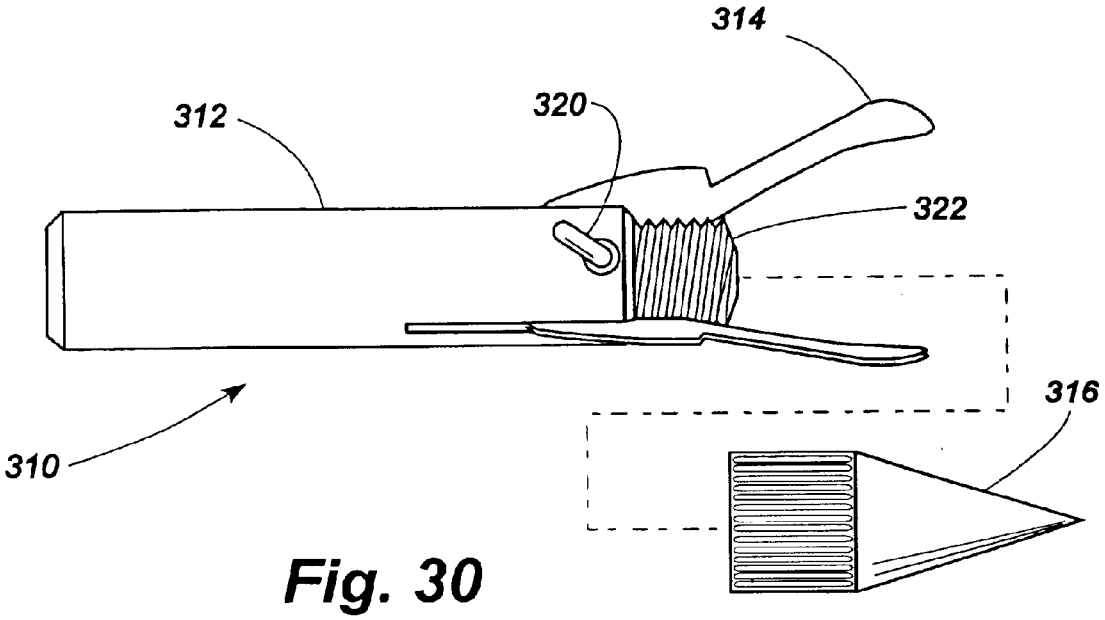
FIG. 30 is a side view of the arrowhead of FIG. 28, with the tip removed and the blades pivoted fully forward.

Referring to FIG. 28, the arrowhead body 312 has a threaded stud 322 at its forward end. The tip 316 has a threaded bore in its rearward end. As shown in FIGS. 28 and 30, the tip is attached to the arrowhead body 312 by screwing the tip 316 onto the threaded stud 322 at the forward end of the arrowhead body.

FIG. 30 shows the blades 314 rotated well forward to facilitate removal of an arrow from a fish. In contrast, FIG. 29, in which the tip 316 is installed, show the blades rotated only to a position substantially perpendicular to the longitudinal axis of the body 314. Thus, the arrowhead tip 316 serves a dual purpose: it serves as a sharpened tip to penetrate the target, and it serves as a stop to limit rotation of the arrowhead blades.

Figure 31:
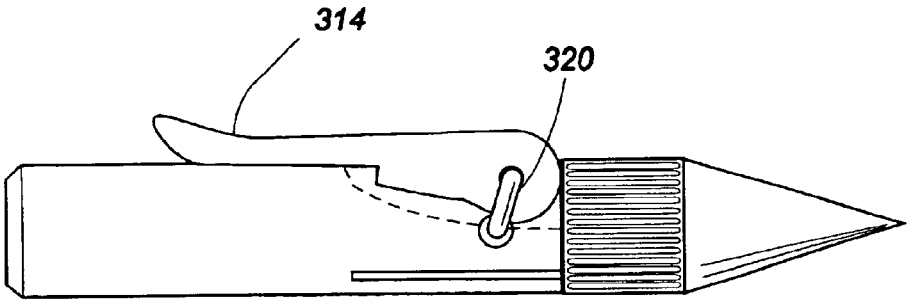
FIG. 31 is a side of the arrowhead of FIG. 28 with the blade retracted against the body and the arrowhead body partially cut away to reveal interior detail.
Figure 32:
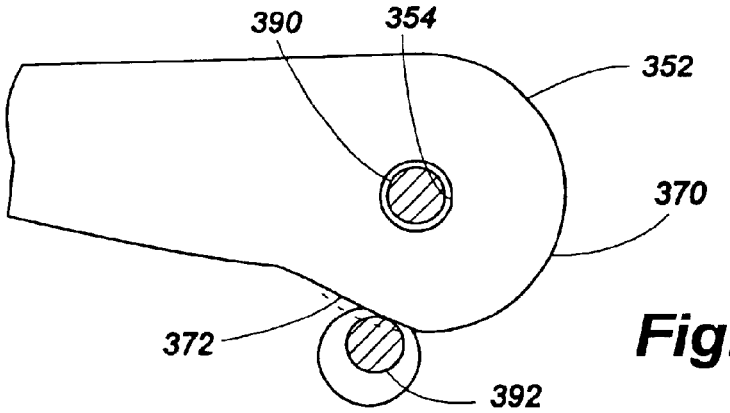
FIG. 32 is an enlarged view of the head of the blade of FIG. 30 showing a U-shaped axle and spring assembly.
Figure 33:
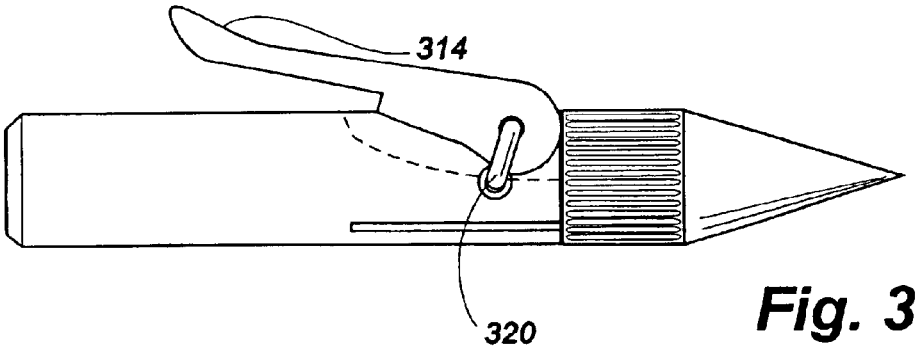
FIG. 33 shows a side view of the arrowhead of FIG. 28 with the blade partially deployed in comparison to the previous position of the blade, which is shown in phantom. Portions of the arrowhead body are cut away to reveal interior detail.
Figure 34:
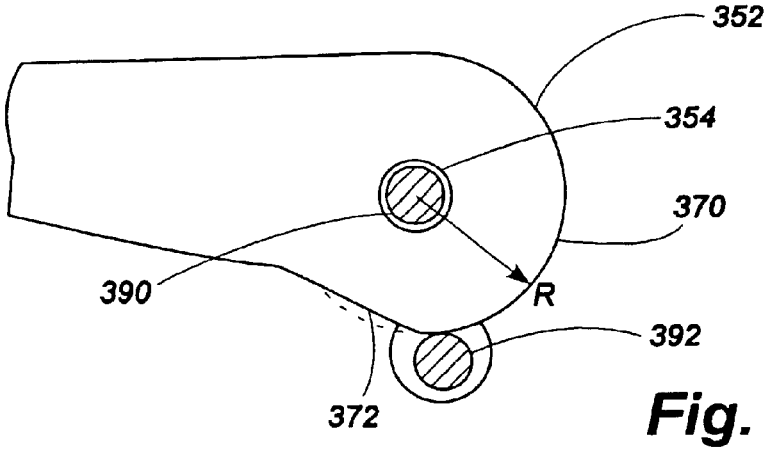
FIG. 34 is an enlarged view of the head portion of the blade and of the U-shaped axle and spring assembly of FIG. 33.

FIGS. 31–34 illustrate the manner in which the U-shaped axle pin and spring leg assembly 320 serves to bias the blade 314 toward its closed position during the blade's first minor arc of rotation but thereafter exerts neither a closing nor an opening force on the blade. The blade 314 has a cam-shaped head portion 352 comprising a first, arcuate portion 370 having a radius R from the center of the mounting hole 354, and a second, flat portion 372 having a generally straight edge whose distance from the center of the mounting hole 354 is less than R. When the blades 314 of the arrowhead 310 are in their fully retracted positions, as shown in FIG. 31, the spring leg 392 resides against a portion of the head 352 of the blade which is approximately closest to the center of the mounting hole 354. As the blade opens during its first minor portion of rotation, as shown in FIG. 33, the distance between the spring leg 392 and the axle pin 390 increases and approaches R. If the blade is released at any point during this first minor portion of rotation, the tendency of the spring leg 392 to return to its normal position will cause the blade to rotate back to its closed position.

Once the blade passes approximately the position shown in FIG. 33, the spring leg 392 engages the portion of the head 352 of the blade 314 which has a constant radius R. During this portion of rotation, the spring 392 neither increases nor decreases its distance from the axle pin 390. Thus releasing the blade during this portion of rotation will not cause the blade to either open or close, as all of the force exerted by the spring leg 392 is being directed perpendicular to the surface of the blade head 352.

Figure 35:
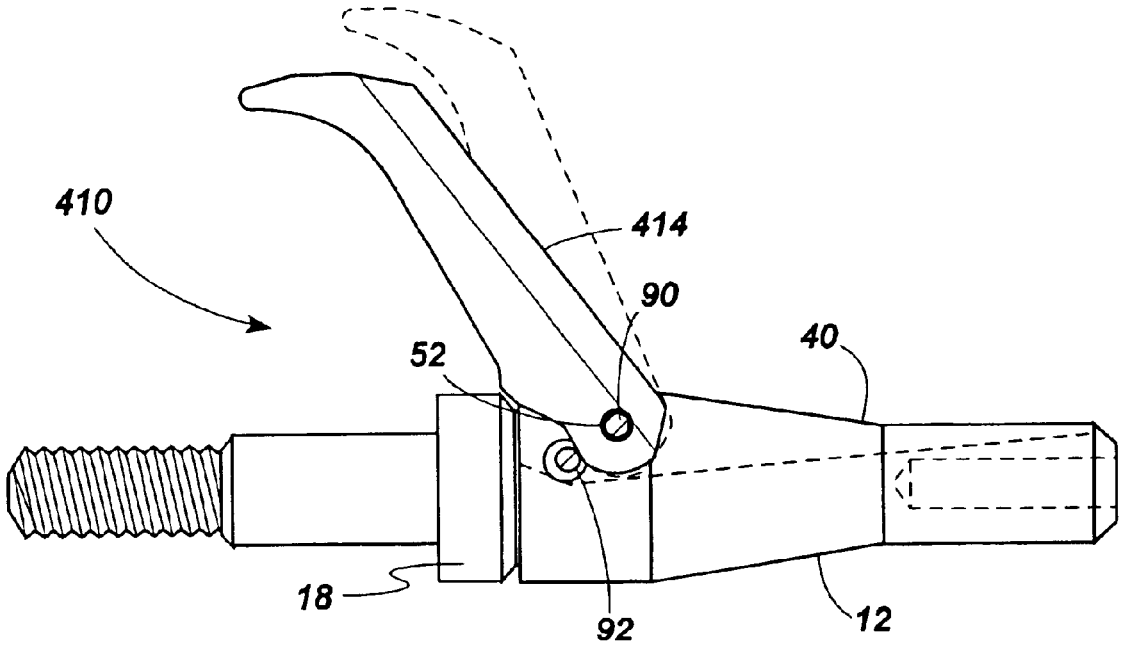
FIG. 35 is a side view of another embodiment of an arrowhead which includes blades with cam surfaces which facilitate both closing and opening the blades during the first and last minor portions of the blades' arcs of rotation.
Figure 36:
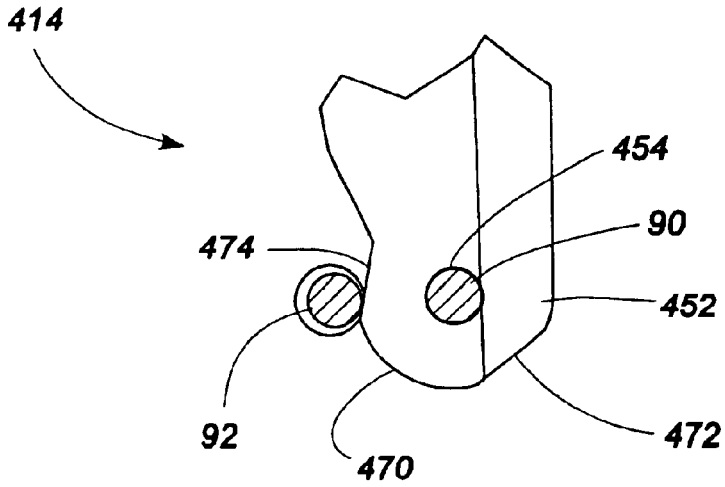
FIG. 36 is an enlarged view of the head of a blade of FIG. 35 showing the cam surfaces, axle, and spring pin.

FIGS. 35 and 36 disclose an embodiment of an arrowhead 410 in which the blade 414 (only one of which is shown for convenience of description) has two flat portions 472, 474 on opposite sides of the cam-shaped head portion 452, interconnected by the partially circular portion 470. When the spring leg 92 engages the partially circular portion 470, force is directed perpendicular to the periphery of the cam-shaped head portion 452, and the blade is biased neither to open nor to close. When the blade 414 is rotated such that the spring leg 92 encounters the flat portions 472 to close, in the same manner explained above for other embodiments. However, in this embodiment when the spring leg 92 encounters the flat portion 474, the spring leg biases the blade to rotate into its fully opened position. Thus, beginning from about the point shown in dashed lines in FIG. 35, the spring leg takes effect and causes the blade 414 to rotate to the fully opened position shown in solid lines in FIG. 35.

One feature of the disclosed embodiments is that the axle pins 90, 190, 290, and 390 which define the axis of rotation of the blades 314, are laterally offset from the longitudinal axis of the arrowhead body 12, 312. This facilitates folding the blades 14, 314 closely against the body 12, 312 and minimizes the depth of the slots 40, 340 which must be formed in the arrowhead body in order to accommodate the blades.

Finally, it will be understood that the preferred embodiment has been disclosed by way of example, and that other modifications may occur to those skilled in the art without departing from the scope and spirit of the appended claims.

What is claimed is:

1. An arrowhead comprising:

a body having a first end, a mounting location, a second end, and a longitudinal axis extending between said first and second ends;

an elongated blade having a first end and a second end, said first end of said blade being pivotably mounted to said mounting location of said body about an axis of rotation such that said blade is pivotably movable between first and second positions;

said blade lying substantially parallel to said longitudinal axis of said body when in said first position with said second end adjacent said first end of said body, and said second end of said blade extending outward and on the side of said mounting location toward said second end of said body when said blade is in said second position;

a bearing surface at said second end of said blade so as to be contacted by a target surface to pivot said blade from said first position to said second position when said bearing surface strikes a target;

said blade having a cam portion formed thereon adjacent said axis of rotation; and a spring adjacent said axis of rotation of said blade and oriented to exert a force against said cam portion of said blade in the approximate direction of said axis of rotation;

said cam portion of said blade being configured such that a biasing force tending to pivot said blade into said first position is exerted during a first minor portion of rotation of said blade between said first position and said second position.

2. The arrowhead of claim 1, wherein said first end of said arrowhead body comprises a forward end, and wherein said second end of said arrowhead body comprises a rearward end.

3. The arrowhead of claim 2, further comprising a point at said forward end of said arrowhead body.

4. The arrowhead of claim 2, wherein said arrowhead body has a longitudinal groove formed therein;

wherein said first position of said blade is a closed position in which said blade is folded against said arrowhead body with a substantial portion of said blade residing within said longitudinal groove;

wherein said bearing surface at said second end of said blade is located adjacent said forward end of said arrowhead body when said blade is in said first position; and wherein said bearing surface impacts upon a target surface as said arrowhead enters a target, thereby causing said blade to rotate from said closed position to an open position in which said second end of said blade extends outward of said mounting location.

5. The arrowhead of claim 2, wherein said cam portion of said arrowhead and said spring are configured such that a biasing force tending to close said blade is exerted during a first minor portion of rotation of said blade between said closed position and said open position.

6. The arrowhead of claim 5, wherein said cam portion of said blade and said spring are further configured such that a biasing force tending to open said blade is exerted during a last minor portion of rotation of said blade between said closed position and said open position.

7. The arrowhead of claim 2, wherein said cam portion of said arrowhead and said spring are configured such that a biasing force tending to open said blade is exerted during a last minor portion of rotation of said blade between said closed position and said open position.

8. The arrowhead of claim 2, further comprising a bearing shoulder disposed on said arrowhead body which a portion of said blade confronts to limit further rotation of said blade, said location of said bearing shoulder thereby defining said second position of said blade.

9. The arrowhead of claim 8, wherein said bearing shoulder is disposed in spaced-apart relation to said axis of rotation, and wherein said arrowhead further comprises means for controlling said spaced-apart relation between said bearing shoulder and said axis of rotation, whereby said second position of said blade can be controlled.

10. The arrowhead of claim 2, further comprising a point member which is removably attachable to said forward end of said arrowhead body.

11. The arrowhead of claim 1, wherein said blade comprises a circular hole therethrough, and wherein said blade is pivotably mounted to said arrowhead body by a pivot pin mounted to said arrowhead body coaxial with said axis of rotation and extending through said circular hole in said blade.

12. The arrowhead of claim 11, wherein said spring comprises a spring pin, and wherein said pivot pin and said spring pin comprise a unitary structure.

13. The arrowhead of claim 12, wherein said spring pin and said pivot pin each have upper ends, and wherein said upper ends of said spring pin and said pivot pin are connected by a bridge member so as to form a "U"-shaped member.

14. The arrowhead of claim 13, wherein said lower end of said pivot pin fits snugly within a corresponding hole in said arrowhead body coaxial with said axis of rotation, and wherein said lower end of said spring pin is free to move.

15. The arrowhead of claim 14, wherein said arrowhead body comprises a recess extending substantially radially from said axis of rotation, and wherein said bridge member is received within said recess to prevent said U-shaped member from pivoting about said pivot pin.

16. The arrowhead of claim 11, wherein said spring comprises a spring pin, wherein said arrowhead body comprises a first hole coaxial with said axis of rotation, and wherein said arrowhead body comprises a second hole in spaced-apart relation to said first hole, said lower end of said pivot pin being received within said first hole, and said lower end of said spring pin being received within said second hole.

17. The arrowhead of claim 1, wherein said first end of said arrowhead body comprises a rearward end, and wherein said second end of said arrowhead body comprises a forward end.

18. The arrowhead of claim 16, wherein said arrowhead body has a longitudinal groove formed therein;

wherein said first position of said blade is a closed position in which said blade is folded- against said arrowhead body with a substantial portion of said blade residing within said longitudinal groove;

wherein said bearing surface at said second end of said blade is located adjacent said rearward end of said arrowhead body when said blade is in said first position; and wherein said bearing surface impacts upon a target surface after said arrowhead has passed through a target and is being pulled back through the target, thereby causing said blade to rotate from said closed position to an open position in which said second end of said blade extends outward of said mounting location.

19. The arrowhead of claim 17, wherein said blade in said open position confronts said point member to prevent further rotation of said blade, whereby said point member defines said open position of said blade.

20. The arrowhead of claim 10, wherein said point member is selectively removable to permit further rotation of said blade, whereby said arrowhead can be pulled through said target by removing said point member and permitting said blade to rotate to a third position in which said second end of said blade extends forward of said mounting location.

21. The arrowhead of claim 1, wherein said biasing force tending to pivot said blade into said first position is directed along a line which passes generally through said axis of rotation.

22. An arrowhead comprising:

an elongated body having front and rear ends;

means at said front end of said body for accepting an arrowhead tip;

means at said rear end of said body for coupling said body to an arrow shaft;

at least one blade member having first and second ends, said first end of said blade member being pivotably mounted to said body such that said blade member is movable between a first position, in which said second end of said blade is disposed adjacent said front end of said body and a major portion of said blade is positioned adjacent said body, and a second position, in which said blade is pivoted toward the rear end of said body and said second end of said blade is disposed in spaced-apart relation to said body;

said pivotable mounting of said blade to said body being accomplished by a U-shaped coupler having first and second legs, said first leg of said U-shaped coupler being fixed with respect to said body and serving as an axis of rotation for said blade, and the second leg of said U-shaped coupler being free so as to be resiliently movable with respect to said first leg;

said first end of said blade being cam-shaped such that said resilient free leg of said U-shaped coupler exerts a force tending to bias said blade toward said first position during only a first minor portion of rotation between said first and second positions.

* * * * *